United States Patent [19]

Dana

[11] 4,019,662

[45] Apr. 26, 1977

[54] FEEDER FOR COHERENT PARTICULATE MATERIAL

[75] Inventor: Paul Robert Dana, Wilmington, Del.

[73] Assignee: Milliken Research Corporation, Spartanburg, S.C.

[22] Filed: Apr. 9, 1973

[21] Appl. No.: 349,305

[52] U.S. Cl. ..... 222/414; 222/177

[51] Int. Cl.[2] ..... G01F 11/20

[58] Field of Search ..... 222/189, 202, 342, 410, 222/414, 203, 177, 406

[56] References Cited

UNITED STATES PATENTS

| | | | |
|---|---|---|---|
| 2,237,504 | 4/1941 | Roath | 222/414 UX |
| 2,643,798 | 6/1953 | Neff | 222/414 X |
| 3,176,881 | 4/1965 | Malby et al. | 222/177 |
| 3,545,875 | 12/1970 | Schneider | 222/414 X |
| 3,596,807 | 8/1971 | Hudson et al. | 222/202 |

FOREIGN PATENTS OR APPLICATIONS

| | | | |
|---|---|---|---|
| 1,429,956 | 6/1965 | Germany | 222/414 |

*Primary Examiner*—Robert B. Reeves
*Assistant Examiner*—Joseph J. Rolla
*Attorney, Agent, or Firm*—H. William Petry; Robert S. Alexander

[57] ABSTRACT

A powder spreading device comprising a powder storage bin, a foraminous wall discharge area, and within the bin a cylinder of resilient reticulated foam which can be rotated, and which is in pressure contact with said plate is disposed to press and wipe against the foraminous wall discharge area thereby urging the powder through the plate, deposits a uniform layer of powder on a substrate.

7 Claims, 6 Drawing Figures

FEEDER FOR COHERENT PARTICULATE MATERIAL

BACKGROUND OF THE INVENTION

1. Field of the Invention

This invention relates to mechanical devices for spreading powders. More particularly it is directed to a device for spreading coherent powder and comprising a bin with a foraminous wall discharge area and a cylinder of resilient reticulated foam disposed to force the powder through the perforations of the foraminuous wall upon rotation.

2. Prior Art

Feeding of powders for deposition in a uniform manner on a substrate has been practiced in the distribution of fertilizers, insecticides and like materials on lawn and farm areas and in the distribution of toners in xerographic copiers. Early rotating brush devices are exemplified by U.S. Pat. No. 1,191,116, while U.S. Pat. No. 3,250,439 discloses the use of a resilient polyurethane pad to push out toner by moving along a row of holes in a discharge plate, and U.S. Pat. Nos. 3,596,807; 3,608,792; 3,128,015 and 3,172,547 disclose a resilient open-celled elastomeric roll which rotates against a slit in the bottom of a bin. Such powders are generally quite dry and do not offer problems of the magnitude found in distributing powders containing a significant amount of liquid. Such liquid-containing powders are coherent and coherent powders tend to bridge the openings through which they must pass and may not feed at all, or may be deposited intermittently in a very uneven pattern. The feed rate of these prior art feeders is unduly sensitive to the moisture content of the coherent powder. The device of this invention overcomes these inadequacies by providing a feeder which utilizes a cylinder of reticulated resilient foam which transports and urges coherent powder through perforations in a discharge plate.

SUMMARY OF THE INVENTION

In summary, this invention is directed to a device for spreading coherent powder, said device comprising a powder storage bin having a foraminous wall discharge area located to provide an uninterrupted vertical path to a substrate, said foraminous wall containing perforations of dimension between 0.02 and 0.125 inch;

a cylinder of pore-tearing resilient reticulated foam rotatably mounted within said bin, and disposed such that on rotating it presses against the wall discharge area forcing said powder through said perforations;

means for rotating said cylinder; and means for moving the device over the substrate.

The devices of this invention permit uniform deposition of coherent homogeneous powders containing significant amounts of liquid.

DESCRIPTION OF THE INVENTION

Figure 1:
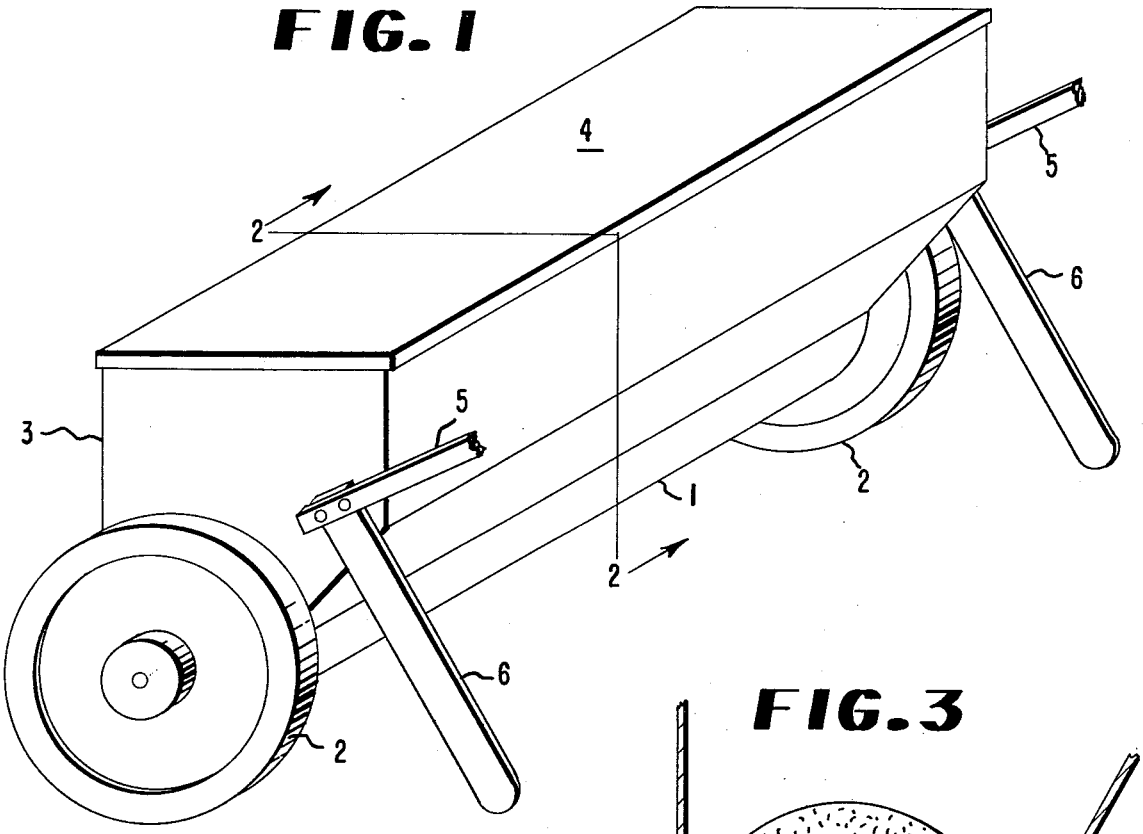
FIG. 1 is an exterior view of a device of this invention.

The invention will be better understood by referring to the drawings in greater detail. Reference characters will be the same where they denote like parts or structural features in the different views.

In FIG. 1, 1 represents a bin with a foraminous discharge area at the bottom; 2 represents wheels for movement of the device; 3 represents a bin wall ; 4 represents a top for the bin, an optional feature; 5 represents the extensions of handle means for manual propulsion of the device and 6 represents means for supporting the device when not in motion.

Figure 2:
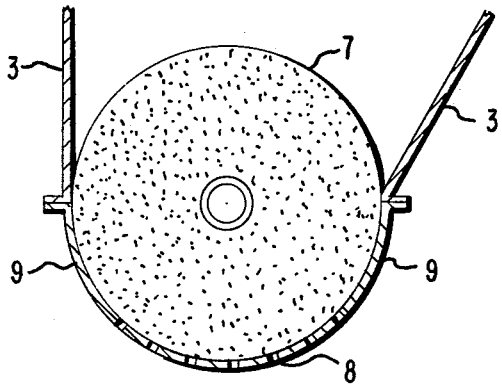
FIG. 2 is a section along line 2—2 of FIG. 1 showing a cross-sectional view of a device of this invention.

In FIG. 2, 3 represents a bin wall, 7 represents a cylinder of resilient reticulated foam placed so that it presses against a foraminous discharge area 8, and 9 represents an unperforated wall section.

Figure 3:
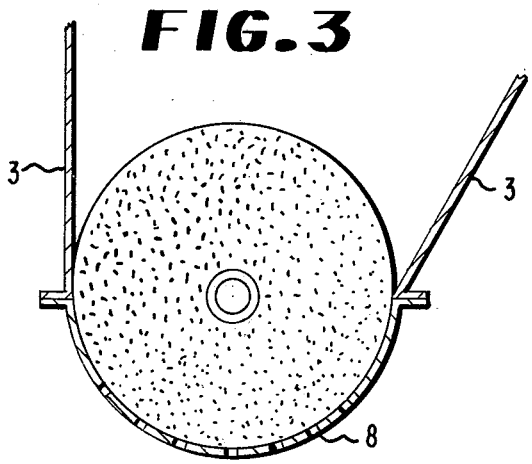
FIG. 3 is another cross-sectional view showing a variation of a device of this invention.

In FIG. 3, pressure contact between the resilient foam cylinder 7 and the foraminous discharge area is achieved by diminishing the radial distance between the axis of the cylinder and the discharge area 8.

Figure 4:
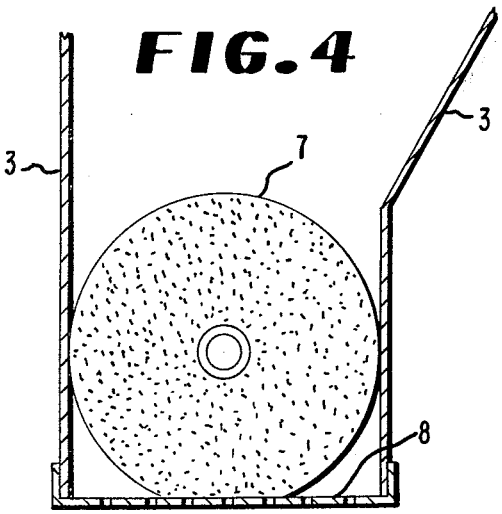
FIG. 4 is also a cross-sectional view showing a variation of a device of this invention.

In FIG. 4 the discharge area 8 is flat and pressure contact is achieved in only part of the plate.

Figure 5:
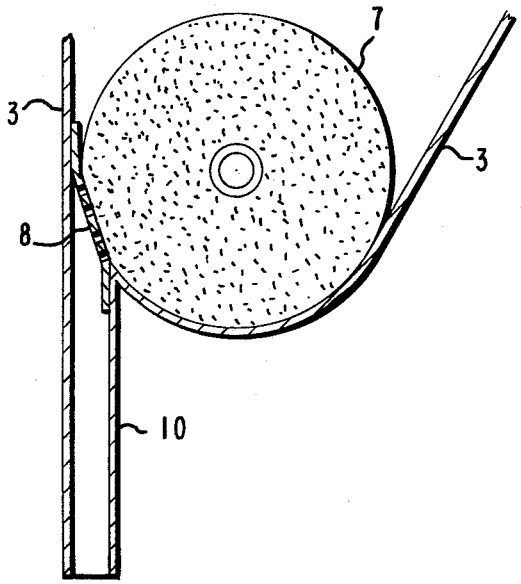
FIG. 5 is also a cross-sectional view of a preferred embodiment of this invention.

In FIG. 5, 3 is the bin wall, 7 represents a cylinder of reticulated resilient foam pressing against discharge area 8 which is positioned above discharge chute 10 for delivering powder close to the substrate.

Figure 6:
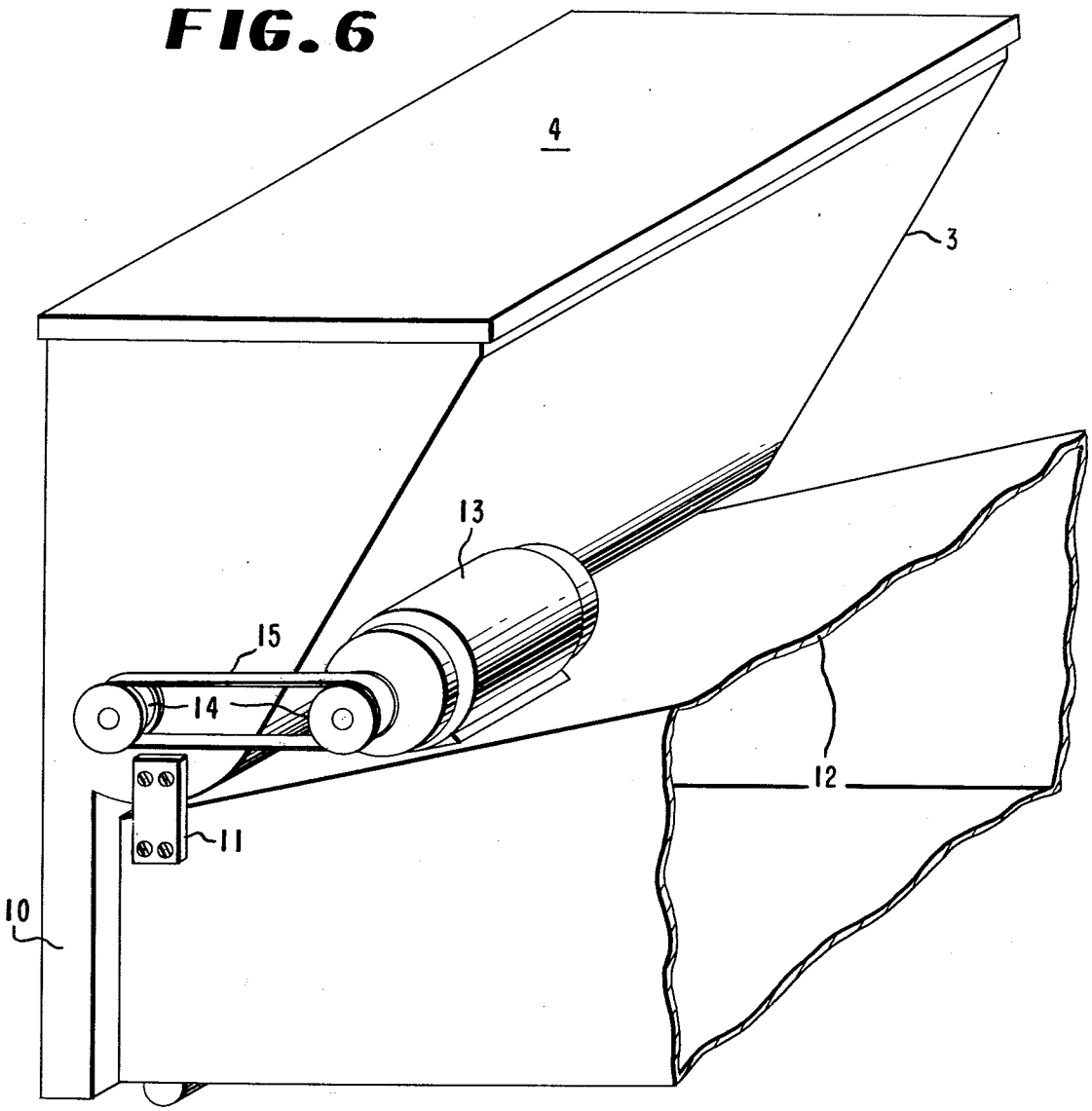
FIG. 6 is an exterior view illustrating integration of a device of this invention with a carpet cleaning device.

FIG. 6 represents an external view of an arrangement of the device in which the feeder is integrated with a carpet cleaning device 12. In this figure, a vertical chute 10 delivers powder to a substrate not shown. Linking means 11 hold the feeder device to the carpet cleaning device 12 and 13 is a motor for driving cylinder shaft 14 with belt 15. The chute 10 discharges powder in a uniform manner directly in front of the cleaning device with minimum exposure to currents of air. The speed of motor 13 can be varied so as to turn the cylinder shaft 14 at faster or slower speed, thereby feeding powder at a faster or slower rate as desired.

In modern methods for the in-place cleaning of carpets, especially wall-to-wall carpets, by applying powder cleaners, then agitating the carpet fiber assembly followed by removal of dirt and cleaning powder by vacuum sweeper or other means, a problem arises in the uniform spreading of coherent cleaning compositions due to the liquid therein, which may comprise water, an organic liquid or their mixtures. Such powders tend to bridge over the openings in screens and perforated troughs, may not feed at all, may feed too slowly for practical application, or may be deposited in irregular and non-uniform fashion on the substrate. Cleaning compositions of this kind are disclosed in U.S. Pat. No. 3,418,243; Belgian Patent 749,570; U.S. Pat. No. 2,344,268; and in U.S. Application Ser. No. 209,402, filed Dec. 17, 1971, now abandoned.

The powder spreading device of this invention overcomes these difficulties by providing several distinct improvements over spreaders of the prior art. One requirement is that the resilient material comprising the rotating cylinder be of a reticulated foam. By reticulated foam we refer to foams, preferably polyurethane, which have been treated to remove the thin part of the membrane of each cell. What remains is a 3-dimensional network of interconnecting strands of resin integrally interconnected by thickened hexus at spaced apart points so as to form an isotropic skeletal outline of a multitude of polyhedrons whose faces are common to a polyhedron adjacent thereto, are open and substantially free from membranous resin and with the network being substantially free from permeatoidally degraded strands and nexus. By permeatoidally is meant throughout the structure as opposed to a topical or surface phenomena. The nature of the structure is explained in U.S. Pat. No. 3,171,820 in column 1 beginning at line 17. Methods of producing such reticulated resilient foams are described in U.S. Pat. Nos. 3,171,820; 3,266,927 and 3,175,025. These foams are also items of commerce.

A second requirement of the devices of this invention is that there be pressure contact between the resilient cylinder and the foraminous discharge plate. Because of the resilient nature of the rotating cylinder the degree of pressure can vary considerably. For example, in FIG. 2, the cylinder may be adjusted so that it barely touches the discharge plate or alternatively it may be positioned so that the foam is compressed while in contact with the discharge plate. In practice it is desirable to have at least a small amount of compression so as to allow for wear of the foam material thereby reducing the number of adjustments that must be made. In FIGS. 3 and 4 the degree of pressure contact with the discharge plate varies because of the geometry of the discharge plate.

A third requirement is that the powder is fed through a foraminous discharge area. The area can be of several types. One satisfactory type of discharge area has holes drilled into it at regular intervals. If the size of the perforations is less than 0.02 inch, the spreader is not capable of delivering adequate amounts of coherent powder for a carpet cleaning application. If the size of the perforations is greater than 0.125 inch the delivery of moist powder will be irregular and the deposit nonuniform. It will be recognized that less moist powders can be spread uniformly through perforations of smaller dimension. In order to spread sufficient volume of powder, it is preferred that there be at least two rows of perforations laterally across the perforated wall area of the bin. Another type of satisfactory discharge area is a wire screen. It is necessary that the screen have sufficient rigidity so that it is not deformed by contact with the rotating cylinder. In general, larger sized screens give higher rates of feed. The preferred size is from 8 to 20 mesh per inch, offering openings or perforations of from 0.094 inch to 0.033 inch. It is frequently desirable to coat the screen with a solid lubricant such as polytetrafluoroethylene.

The type of resilient foam is important. Polyurethane foams are preferred since they are readily available and are resistant to abrasion. Reticulated foams are superior to non-reticulated foams because much higher feed rates can be achieved. All reticulated foams will give adequate feed rates but the highest rates are obtained with reticulated foams having from 5 to 20 pores per lineal inch and foams with pores of this size are preferred. Reticulated foams with pores larger than 5 per lineal inch are not readily available. Compared to brushes, cylinders of resilient reticulated foam are superior because they have a higher feed rate, give more even feeding, require less adjustment, do not take a permanent set and have been found in general to be more reliable.

The cylinder can vary in size and type of construction. Cylinders having a diameter of four inches have been found to be very satisfactory but cylinders with both larger and smaller diameters are also satisfactory. The cylinder can be of all foam construction in which event it is attached on each end to disks which are rotated. Alternatively a sheet of reticulated resilient foam can be attached to a center shaft in any known manner. No criticality is seen in the manner in which this is done so long as the foam surface in contact with the foraminous area is uniform. The shaft can be linked to the wheels of the spreader, revolving once with each revolution of the wheels or adjusted to turn more or less rapidly by linking the shaft and wheels by means of gears or pulleys. One preferred method is to rotate the cylinder by means of a separate motor which offers the opportunity of choosing a desired speed of rotation. An electric motor is most convenient but other means such as a gasoline engine can be used. The ability to control the speed of rotation is desirable since, for a specific powder, the rate of feed is proportional to rotational speed of the cylinder. In addition the rate of longitudinal movement of the device must be controlled, since when cylinder speed is constant and not geared to the rate at which the wheels move, the deposit will not be uniform in the longitudinal direction unless the wheels also turn at uniform speed. Where the wheels are turned mechanically at a constant speed, and the rate of cylinder rotation is adjustable, a uniform deposit of powder can be attained, at whatever rate is desired.

As indicated by the drawings, the shape of the bin is not critical, however a half cylinder or regularly curved vessel closely resembling a half-cylinder is preferred. While the foraminous discharge area can be at the bottom of the bin as in FIGS. 2, 3 and 4, a design corresponding to that shown in FIG. 5 is preferred. In the FIG. 5 design, for example, a cleaning composition can be deposited very close to the edge of a wall-to-wall carpet, which affords improved utility. In addition, the preferred design is more easily combined with other cleaning elements in a carpet cleaning process, since the powder bin and cylinder can be raised vertically and, therefore, located directly over an agitator or a suction cleaning device in a machine incorporating these elements as parts of a completely integrated carpet cleaning device.

The ease of spreadability of powders can vary greatly, depending largely on their liquid content. Coherent powders are powders which tend to agglomerate and form a unified mass. Such coherent powders can be packed in the hand like a snowball, retaining the shape produced. Such powders can be spread with satisfactory uniformity with spreaders having the critical requirements of the devices of this invention.

Coherent powders as defined herein can contain up to about 60% liquid. The actual coherence of a powder depends to some extent on the nature of the liquid, i.e., water; an organic liquid such as a hydrocarbon, halogenated hydrocarbon or an alcohol; or mixtures of these. The coherence of the powder also depends somewhat on the nature of the solid particles, particularly their porosity. Particles of high porosity can absorb more liquid while retaining a dry character than can particles of low porosity.

One difficulty sometimes encountered with coherent carpet cleaning powders is that the moisture content of the powder will vary somewhat due to its having been stored for a time in the spreader, or a lid inadvertently being left off a container or for other reasons. Since the coherence of a powder varies with its moisture content, the amount of powder which is fed will also change with the moisture content. An advantage of devices of the present invention is that their feeding rate is less sensitive to moisture content of the powder than other known devices.

The powder spreading devices of this invention can be propelled manually or by mechanical means. They can be employed as a unit alone, or can be attached to or associated with supplementary apparatus such as carpet fiber agitators as disclosed in U.S. Patent Application Ser. No. 209,392, filed Dec. 17, 1971, now abandoned. While the devices of this invention were developed primarily in answer to a need associated with the spreading of a rug cleaning composition, their use is not limited to this application. They can be used to spread any coherent powder including fertilizer and other powders for lawn, farm, or garden treatment. They are also useful for the distribution of various chemical and food powders on belts or pans for subsequent drying, for the even distribution of toners in xerographic copiers, and wherever it is desired to distribute evenly a powder that is difficult to feed because of its cohesive nature.

Materials of construction can vary widely, metal or plastic being particularly satisfactory. The storage bin of the feeder can be constructed so that the discharge area can be a replaceable section, readily removed and replaced with another section bearing perforations of different size or arrangement. Feed rates can be varied by use of a movable solid plate adjacent to the discharge area. Thereby the effective area of discharge can be increased or decreased by positioning the solid plate.

The following examples illustrate this invention. Parts and percentages referred to therein are by weight unless otherwise designated.

EXAMPLE 1

The following test was made with a spreader as shown in FIGS. 5 and 6. The feeder was driven with a 1/50 horsepower electric gearmotor. A foraminous discharge plate installed in the spreader was an 8-mesh per inch stainless steel screen. The test was run to make a comparison between a reticulated foam roller and a brush as the active element in the spreader. The brush used was a 4 inch diameter open faced brush with nylon bristles. The foam cylinder was constructed by glueing 8 pore per inch open-celled reticulated foam (Scott Paper Co.) onto a stainless steel shaft. The foam was then trimmed to a 4 inch diameter cylinder.

For the test a cleaning powder of the following composition was prepared.

a. 60 parts by weight of porous urea-formaldehyde resin particles of which 42% passed through a 325 mesh per inch screen and essentially 100% passed through a 140 mesh per inch screen.

b. 36 parts by weight water.

c. 4 parts by weight surfactants consisting of

2 parts octodecyltrimethylammonium chloride (Arquad 18-100; Armek Chemical Division of Akzona Inc.) and

2 parts alkylaryl ether alcohol made from one mole of octophenyl phenol and five moles of ethylene oxide (Triton X-45; Rohm and Haas Co.).

The cleaning powder was prepared by first dissolving the surfactants in the water and then blending the powder with this solution until a homogeneous mixture was obtained.

The brush was installed in the spreader and adjusted in an interference fit, that is, the bristles were noticeably bent as they passed across the perforated bin and penetrated through the perforations at rest. The cleaning powder was then put into the hopper and the spreader was operated until the brush had become filled with powder and the spreader was operating at a steady state condition. At this time a pan was placed under the discharge chute. The spreader was turned off when the pile of collected powder was about ¾ inch high.

The reticulated foam roller was then installed in place of the brush and the same experiment was run. The piles of powder were then compared. It was found that the pile from the foam roller test was much more even than the pile from the brush test across the width of the feeder.

EXAMPLE 2

A test was made to determine the need for the foraminous discharge area by operating the spreader without the plate installed. The experiment was run using the open-pore reticulated foam and the cleaning powder described in Example 1. With the roller installed and without the discharge plate the foam can turn in the spreader without any compression or deflection of the foam. Under this test condition, it was found that the delivery of powder was unsatisfactory. The feed rate was slow and very uneven across the width of the feeder.

A second test was made by installing metal strips on both sides of the chute opening. These strips were installed so that they depressed the foam roller about ¼ inch as the roller passed them. A comparison was then made between this configuration and the spreader as described in Example 1 with the foam roller and screen installed. The comparison was made by mounting the spreader on a cart and pulling the cart across the floor at a constant rate of speed. While the cart was moving, the feeder was operated and the pattern of powder deposited on the floor was observed. A comparison of the two modes of operation indicated that when the screen was installed in the spreader, the powder was more evenly distributed over the floor.

EXAMPLE 3

The following experiment was made to determine the influence of the pore size in the reticulated foam, the screen openings and the moisture content on the feed rate of the spreader. Three reticulated foam rollers were used of 10, 20 and 40 pores per inch. The screens tested were 8 mesh per inch and 20 mesh per inch. Three cleaning powders were prepared as described in Example 1 with 35, 40 and 45% cleaning fluid where the cleaning fluid consists of the water plus surfactant as described in Example 1.

For each test a given screen and foam roller were installed in the spreader and a given cleaning powder was charged. After allowing a little operating time for the feed to reach a steady state of operation, a timed sample was collected and weighed. For all the tests the reticulated foam roller was turned at a constant speed of 10 revolutions per minute. The data are expressed as grams of cleaning powder fed per revolution of the roller and are reported in Table I.

TABLE I

| Foam Pore Size per in. | Grams of Cleaning Powder per Revolution % Cleaning Fluid 35% | 40% | 45% | Screen Mesh per in. |
|---|---|---|---|---|
| 10 | 20.0 | 21.2 | 22.4 | 8 |
| 20 | 14.2 | 13.6 | 12.8 | 8 |
| 40 | 11.0 | 8.4 | 5.4 | 8 |
| 10 | 16.6 | 12.4 | 11.0 | 20 |
| 20 | 11.4 | 11.6 | 8.0 | 20 |
| 40 | 8.2 | 7.0 | 4.0 | 20 |

As can be seen from these data, increased feed rates are obtained by using a large pore foam and a large mesh screen, and the larger pore foams give a more consistent feed rate with the variation in the cleaning fluid content of the powder.

I claim:

1. A device for spreading coherent powder, said device comprising a powder storage bin having a foraminous wall discharge area located to provide an uninterrupted vertical path to a substrate, said foraminous wall containing perforations of dimension between 0.02 inch and 0.125 inch;

a cylinder of pore-bearing resilient reticulated foam rotatably mounted within said bin and disposed such that on rotating it presses against the wall discharge area forcing said powder through perforations;

means for rotating said cylinder; and means for moving the device over the substrate.

2. A device of claim 1 wherein the foam cylinder has from about 5 to about 20 pores per lineal inch.

3. A device of claim 1 wherein the dimension of the perforations is between about 0.033 and about 0.094 inch.

4. A device of claim 3 wherein the foam cylinder has from about 5 to about 20 pores per lineal inch.

5. A device of claim 1 wherein the perforated wall area is located near the front of the powder storage bin and combined with a vertical chute to facilitate combination of the device with elements for cleaning horizontal substrates.

6. A device of claim 5 wherein the dimension of the perforations is between about 0.033 and 0.094 inch and the foam cylinder has from about 5 to about 20 pores per lineal inch.

7. A device of claim 5 wherein foam cylinder is a polyurethane foam.

* * * * *

UNITED STATES PATENT OFFICE
CERTIFICATE OF CORRECTION

Patent No. 4,019,662 Dated April 26, 1977

Inventor(s) Paul Robert Dana

It is certified that error appears in the above-identified patent and that said Letters Patent are hereby corrected as shown below:

Column 1, line 24, "3,172,547 should read --3,172,574--.

Column 3, line 1, "hexus" should read --nexus--.

Signed and Sealed this thirtieth Day of August 1977

[SEAL]

*Attest:*

RUTH C. MASON
*Attesting Officer*

C. MARSHALL DANN
*Commissioner of Patents and Trademarks*